United States Patent [19]

Coraor et al.

[11] 3,998,588

[45] Dec. 21, 1976

[54] PROCESS FOR CONTINUOUSLY TRANSFERRING HEAT TO A MOVING BAND

[75] Inventors: George R. Coraor, Wilmington; Harold L. Jackson, Hockessin; Frederick W. Mader, Wilmington, all of Del.

[73] Assignee: E. I. Du Pont de Nemours and Company, Wilmington, Del.

[22] Filed: May 28, 1975

[21] Appl. No.: 581,568

[52] U.S. Cl. ..... 8/176; 8/94 A; 8/116 R; 8/149.2; 8/DIG. 16; 165/1

[51] Int. Cl.[2] ..... D06P 3/00; D06P 5/00

[58] Field of Search ..... 8/176, 149.2, DIG. 16, 8/94; 165/1

[56] References Cited

UNITED STATES PATENTS

| | | | |
|---|---|---|---|
| 3,542,506 | 11/1970 | Case et al. | 8/142 |
| 3,564,723 | 1/1969 | Passey et al. | 34/22 |
| 3,667,898 | 6/1972 | Bergman et al. | 8/94 |

FOREIGN PATENTS OR APPLICATIONS

| | | |
|---|---|---|
| 760,243 | 5/1971 | Belgium |
| 2,002,206 | 7/1971 | Germany |
| 2,161,732 | 6/1973 | Germany |

OTHER PUBLICATIONS

"Dyeing From Organic Solvents"—Farben Revue, 1971, Special Edition 13, pp. 78–97.

Brekke et al., J. Amer. Oil Chemists' Society, 1959, 3b, pp. 256–260.

*Primary Examiner*—Harry Wong, Jr.
*Assistant Examiner*—A. L. Clingman

[57] ABSTRACT

Process for continuously transferring heat to a moving band of solid material, for example, a textile, a film, particles, or any shaped or unshaped article, the band preferably comprising a disperse dyeable synthetic polymer, for example, a polyester or polyamide, said process comprising passing the band through a substantially enclosed purging-drying region containing the superheated condensable vapor of a liquid having an atmospheric pressure boiling point of less than 120° C., thence immediately thereafter through a substantially enclosed, heat-transfer region containing the superheated condensable vapor of a fluorocarbon having a fluorine to carbon atom ratio of at least 1.5, a solubility parameter of not more than 6.5 and a molecular weight of at least about 300, the pressure in the heat transfer region being no greater than that in the purging-drying region, thence immediately thereafter through a substantially enclosed purging region containing dry steam, the pressure in the purging region being no less than that in the heat-transfer region, and thereafter recovering the band of material, said process characterized by efficient heat transfer resulting from rapid convective movement of superheated fluorocarbon in the heat-transfer region and by minimum loss of such vapor to the atmosphere.

13 Claims, No Drawings

PROCESS FOR CONTINUOUSLY TRANSFERRING HEAT TO A MOVING BAND

BACKGROUND OF THE INVENTION

1. Field of the Invention

This invention relates to a continuous process for efficiently transferring heat to a moving band of solid material.

2. Description of the Prior Art

The use of superheated vapor for drying articles and for heat fixing dyes in synthetic polymers is well known. For example, Belgian Pat. No. 760,243 discloses the use of recycled heavier-than-air superheated solvent vapors for fixing dyes, particularly those applied to fabrics from organic solvents. The preferred organic solvents are the chlorinated hydrocarbons, especially the aliphatic chlorocarbons having boiling points of 80° – 150° C. German Publication No. 2,161,733 discloses the use of superheated vapors of 1,1,2-trichloro-1,2,2-trifluoroethane or trichlorofluoromethane for drying articles which are wet therewith. U.S. Pat. No. 3,762,872 discloses the simultaneous drying and heat fixing of dyes on textiles using the superheated vapors of various chlorocarbons, chlorofluorocarbons or fluorocarbons. U.S. Pat. No. 3,542,506 discloses the use of superheated steam, moving in a countercurrent direction, for sweeping organic vapors from a band of material containing same. Thereafter, the steam and the organic vapors are condensed, the water layer is discarded, and the organic layer is recovered. Finally, it is known to exclude non-condensable gases, such as air, from enclosures for treating textiles with organic vapors in order to facilitate condensation of the vapors.

In general, the prior art textile treating processes usually provide practical rates of heat transfer only if the superheated vapors pass over the fabric at an accelerated rate. Blowers and other means are employed to achieve rapid circulation.

DETAILED DESCRIPTION OF THE INVENTION

Figure 1:
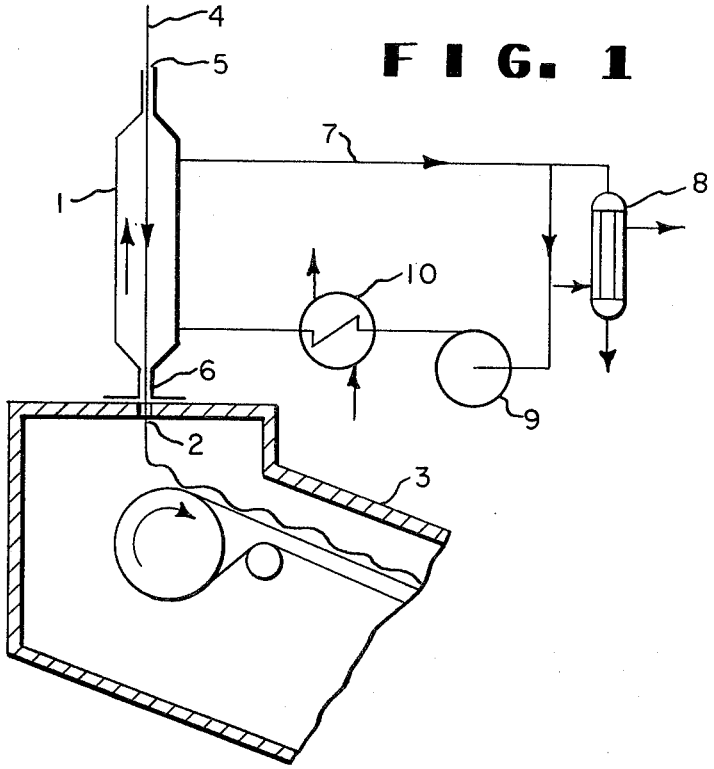
FIG. 1 is an elevation view showing a purging-drying chamber at the band inlet end of a heat-transfer chamber.

This invention is directed to a process for continuously and efficiently transferring heat to a moving band of solid material, for example, a textile, a film, particles or any shaped or unshaped article. The band of material may be continuous, such as a fabric, yarn, an unsupported film or a coating on a substrate, or it may be discontinuous, for example, staple fibers, fusible powders or powder compacts, being carried on a belt, a jet stream or other support. The solid materials may comprise synthetic polymers, metals, ceramics and products of natural origin, such as minerals, ores, cotton and wool. There is provided by this invention a process for rapidly and efficiently transferring heat to a moving band of solid material with minimum energy expenditures and freedom from environmental pollution. More specifically, the process comprises:

a. passing the band through a substantially enclosed purging-drying region through which the superheated condensable vapor of a water-immiscible liquid having an atmospheric pressure boiling point of greater than 20° C. but less than about 120° C. is substantially concurrently passed to dry the band and/or to purge noncondensable gas, for example, air, from the band;

b. immediately passing the band from (a) through a substantially enclosed heat-transfer region containing circulating superheated condensable vapor of a fluorocarbon having a fluorine to carbon atom ratio of at least 1.5, a solubility parameter of not more than 6.5 and a molecular weight of at least 300, to effect the desired heat-transfer, the heat-transfer region being substantially free of noncondensable gas and at a pressure no greater than that in the purging-drying region;

c. immediately passing the band from (b) through a substantially enclosed purging region through which dry steam is substantially concurrently passed to purge fluorocarbon vapor from the band, the purging region being substantially free of noncondensable gas and at a pressure which is no less than that in the heat-transfer region;

d. passing the band, substantially free of fluorocarbon, out of the purging region and recovering the band; and e. recovering and recycling fluorocarbon from the heat-transfer and purging regions.

The condensable vapors employed in the purging-drying and heat-transfer regions must be condensable using water cooled condensers and conventional refrigeration equipment. More specifically, the liquids from which the condensable vapors are produced must have atmospheric pressure boiling points of at least 20° C. Correspondingly, the noncondensable gases referred to herein are not condensable in such equipment and, in liquid form, have atmospheric pressure boiling points of less than 20° C.

The superheated condensable vapor in the purging-drying region provides an atmosphere which removes noncondensable vapors, particularly air, from the band of material and serves as a seal to prevent noncondensable vapors from entering the heat-transfer region. The superheated vapor in the purging-drying region may also provide a drying function to remove liquid from a band of material which may be wet therewith. Such a liquid wetting of the band of material may, but need not, be any liquid, including water and/or an organic liquid which is used in processing the material. The purging-drying region may be used, for example, to remove the water and/or organic liquid medium from a textile fabric following padding in a dye bath; dye fixation may then be effecteed or completed in the heat transfer region.

The superheated condensable vapor in the purging-drying region can be dry steam or the vapor of an organic water-immiscible liquid. Dry superheated steam is preferred if the entering band of material is dry or if the liquid wetting the band is water. Generally, for dry bands of material, the temperature of the steam should be sufficient to prevent condensation on the material, for example, above 100° C. at atmospheric pressure. For bands of material which are wet with water, steam temperatures of about 130°–200° C. are preferred.

Organic water-immiscible liquids (that is, having a solubility of less than 1 weight % in water at 25° C.) having boiling points above 20° C. and which can yield superheated vapors which are stable above the boiling point of liquid wetting the incoming material are suitable for use (as superheated vapor) in the purging-drying region. For operational safety is is desirable that such liquids be non-flammable. For energy conservation the liquid should possess a specific heat less than about 0.6 calorie/gram/° C. at about 25° C. and a latent heat of vaporization less than about 100 calories/gram. Preferably, the specific heat should be less than about 0.3 calorie/gram/° C. at about 25° C. and the latent heat should be less than about 50 calories/gram. Liquid fluoro, chloro, and chlorofluoro substituted and unsubstituted aliphatic and cycloaliphatic hydrocarbons and aliphatic and cycloaliphatic fluoroethers and fluoro-tert.-amines are suitable liquids which can be employed to provide the vapors in the purging-drying region. However, the fluorine-containing compounds are preferred since they are non-flammable and they are insoluble in most band materials. The unsubstituted hydrocarbons are generally flammable and the chloro substituted compounds may be imbibed by certain materials, for example, polyester textiles, and, therefore, may be difficult to recover from the band. The fluorine-containing compounds are favored because of their low specific heats and latent heats which minimize energy requirements. Fluorine-containing compounds suitable as vapor in the purging-drying region include perfluorodimethylcyclohexane, perfluorodimethylcyclobutane, perfluorohexane, perfluoro(N-propylmorpholine), perfluoro(2-butyltetrahydrofuran), perfluoro(2-propyltetrahydropyran), hexafluoropropylene oxides of the formulas $F[CF(CF_3)CF_2O]_n$-$CHFCH_3$ and $F[CF(CF_3)CF_2O]_nCF_2CF_3$, $n$ being 1–2. Other suitable fluorine-contaning compounds are the chlorofluorocarbons, for example, trichlorofluoromethane, 1,1,2-trichloroperfluorocyclobutane, 2,2- and 2,3-dichloroperfluoropropane and 2,3-dichloroperfluorobutane. Trichlorofluoromethane and 1,1,2-trichloro-1,2,2-trifluoroethane are preferred. Constant boiling azeotropes having 1,1,2-trichloro-1,2,2-trifluoroethane as a major component can also be used, for example, $CF_2ClCFCl_2$:$C_2H_5OH$ (4% by wt. $C_2H_5OH$), $CF_2ClCFCl_2$: $(CH_3)_2CO$ (11.6% by wt. acetone), $CF_2ClCFCl_2$:$CH_2Cl_2$ (49.9% by wt. $CH_2Cl_2$) and $CF_2ClCFCl_2$:$CH_3NO_2$ (2.9% by wt. $CH_3NO_2$).

The superheated vapor in the purging-drying region is readily generated and circulated therein by means known to the art. For example, exterior to the purging-drying region, the liquid can be boiled and the vapor therefrom can be conducted through means for superheating gases. The superheated vapor then can be conveyed, for example, by means of a pump or blower, into the purging-drying region through which the band of material is passing. The contact time of superheated vapor with the band material to achieve the desired removal of non-condensable gas and/or to remove liquid from the material will vary according to the temperature of the superheated vapor, the vapor contact efficiency, the vapor flow rate, the boiling point of the liquid on the material and the speed of the moving band of material. In a preferred embodiment of the invention the superheated vapor can be recycled around a loop which includes a superheater, a pump and the band of material. Any excess vapor, including vapor from the band wetting liquid, may be vented from the loop and returned to appropriate storage containers via a condenser and appropriate separation means. Preferably, if possible, the liquid used to generate the vapor the purging-drying region is the same as the band wetting material, thus simplifying recovery.

From the purging-drying region the moving band passes immediately and directly into the heat transfer region, that is, into the superheated vapor of one or more fluorocarbons, substantially free of non-condensable gas, maintained at a pressure no greater than that in the purging-drying region. The heat transfer region generally includes means for conveying the band through the region. Such means are well known to the art and may comprise, for example, a moving belt, a pair of endless traveling chains equipped with clips for holding the band or suitably directed jet streams of the vapor. The fluorocarbon employed in the heat transfer region must meet certain requirements. First of all, it must have a solubility parameter of not more than 6.5. This ensures that the fluorocarbon will not dissolve the band material or any associated agent, such as a dye, which may be present, thus reducing the yield of fixed dye on the band, or interact in any way with the band of material or associated agent. Solvency power is conveniently expressed in terms of the Hildebrand solubility parameter. The theory underlying the solubility parameter is that materials of similar solubility parameter tend to be miscible with each other whereas those with widely different solubility parameters are not miscible with each other. The solubility parameter can be calculated from the equation $$\delta = \left[ \frac{\Delta H - RT}{V} \right]^{1/2}$$

wherein δ is the solubility parameter, ΔH is the heat of vaporization per mole, R is the gas constant, T is the absolute temperature and V is the volume per mole, all in consistent units. The units of δ as used herein are those commonly used, namely, $(cal/cc.)^{1/2}$. The importance of the low solubility parameter of the fluorocarbon can particularly be seen in the use of the instant invention process in connection with the continuous fixation of dyes and/or textile agents on disperse dyeable synthetic polymer fibers. Dyes and textile agents are polar and normally have relatively large solubility parameters, for example, at least 10, and thus are not affected by the fluorocarbon during the dyeing or treating process. Similarly, the disperse dyeable synthetic organic polymers have relatively large solubility parameters; none of the fluorocarbons employed herein is imbibed by such polymers.

A second requirement of the fluorocarbon used in the heat transfer region is that it have a fluorine to carbon atom ratio of at least 1.5. The remaining constituents of the molecule are usually hydrogen atoms, other halogens, particularly chlorine atoms, or heteroatoms, in particular ether oxygen or tertiary amine nitrogen atoms.

A third requirement of the fluorocarbon used herein is that it have a molecular weight of at least 300. The relatively high molecular weight of the fluorocarbon, combined with superheating in a manner so as to place the vapors in circulation, results in greatly improved heat transfer to the band. Efficient transfer of heat to the band of material requires good circulation of the superheated fluorocarbon vapor over and/or through the material. Good circulation also is essential for superheating the fluorocarbon vapor. Although a blower or pump may be used to provide circulation, when using the superheated vapor of a fluorocarbon as defined herein, forced circulation is not necessary. Circulation of the superheated fluorocarbon vapor can be achieved by means of baffles which separate the vapor being superheated from the superheated vapor contacting the band of material. Circulation results from the difference in density between the hotter vapor in contact with the superheater and the cooler vapor which results when the superheated vapor contacts the band of material. Exact positioning of the baffles may be determined by methods well known in the art and is dependent on the degree of vapor circulation desired, the vapor density of the particular fluorocarbon used and the amount of superheat desired. Table 1 shows the circulation driving force, expressed in the relative pressure difference (in cm. of water), which is generated by a 20° C. temperature difference in the two arms of a circulation path, for example, 220° C. in the region of heater 25 andd 200° C. in cocurrent contact zone 15 of FIG. 2.

TABLE 1

| | Circulation Driving Force (cm. of $H_2O$) |
|---|---|
| Perfluorooctane | 6.6 |
| $F(CF(CF_3)CF_2O)_4CHFCF_3$ | 5.6 |
| Perfluoro(tributylamine) | 10.2 |
| Perfluoro(1-methyldecalin) | 7.6 |
| Tetrachloroethylene | 2.5 |

The fluorocarbons which are useful in the heat transfer region exhibit a circulation driving force of greater than 5.1 cm. of water. Such materials generate their own circulation and supplement dry circulating means, for example, a blower, is not required. As shown by Table 1, tetrachloroethylene exhibits insufficient circulation driving force to be useful herein. Operable fluorocarbons include fluorinated alkanes, fluorinated cycloalkanes, fluorinated alkyl ethers, fluorinated cycloalkyl ethers, fluorinated tertiary alkyl amines and fluorinated tertiary cycloalkyl amines, all having attached to the carbon atoms thereof no more than one nonfluorine atom (for example, H or Cl) per ten fluorine atoms. Usually preferred are such compounds which are perfluorinated. Most preferred compounds of the formula $F(CF(CF_3)CF_2O)_nCHFCF_3$ wherein $n$ is 3–5. Table 2 includes solubility parameters of fluorocarbons which are useful herein.

TABLE 2

| Fluorocarbon | Solubility Parameter |
|---|---|
| $F(CF(CF_3)CF_2O)_nCHFCF_3$ | |
| n = 2 | 5.5 |
| n = 3 | 5.4 |
| n = 4 | 5.2 |
| n = 5 | 4.9 |
| perfluoro(1-methyldecalin) | 6.4 |
| perfluoro(dimethylcyclohexane) | 6.1 |
| perfluorooctane | 5.7 |
| perfluoro(tributylamine) | 5.6 |
| perfluoroundecane | 5.9 |
| 1-chloro-perfluorononane | 6.0 |

The selection of the fluorocarbon may depend at least in part on the temperature at which the heat transfer region is operated. Generally, the fluorocarbon employed will have a boiling point of at least 125° C. Useful fluorocarbons include not only the perfluoropropylene oxides of the formula shown in Table 2 but materials of such formula wherein $n$ is 2–9. Such materials are preferred, especially those wherein $n$ is 3 – 5. Also useful are compounds of the formula $F(CF(CF_3)CF_2O)_nCF_2CF_3$ wherein $n$ is 2–9 and mixtures, such as perfluorokerosene and perfluoropropyltetrahydropyran and perfluorobutyltetrahydrofuran mixtures.

From the heat transfer region the moving band passes immediately and directly into the purging region containing dry superheated stream which is maintained at a pressure at least equal to the pressure in the heat transfer region. In the purging region the stream contacts the band to remove fluorocarbon values from the band for recovery. The steam also serves to seal the heat transfer region from the atmosphere. The removal of fluorocarbon from the band is effected by a continuous flow of steam, preferably in a direction countercurrent to the direction of band movement. If the band is an open structure, the steam preferably should pass through the band. The temperature of the superheated steam in the purging region should be high enough so that there is no substantial condensation of liquid on the band. After passing through the purging region the band is recovered.

As is obvious from the above discussion, each region is substantially isolated from the atmosphere, including non-condensable gases, for example, air. Such gases interfere with the efficient condensation recovery of the fluorocarbon. In practice, the three regions are contiguous to further preclude interference by any noncondensable gas. Finally, in describing the second region as the heat transfer region it is not intended to imply that heat transfer takes place only in this region.

The process of this invention has special significance in the continuous dyeing and finishing of textile products since it provides the high production rates, energy conservation and freedom from pollution needed by the textile industry. Particular utility resides in the heat fixing of organic disperse dyes in textiles of disperse dyeable synthetic organic polymers and in the heat fixing and/or curing of textile agents on textile fabrics and webs. As the term is used herein, a disperse dyeable synthetic organic polymer includes any synthetic organic polymeric material which is normally dyeable with disperse dyes under art-recognized conditions for aqueous disperse dyeing. Such polymeric materials include acid-modified polyacrylics (modacrylics), polyesters, polyamides and cellulose acetates, such as cellulose diacetate and cellulose triacetate. Polyesters, such as polyethylene terephthalate, and polyamides, such as 66 nylon, are especially useful in the process of this invention. The synthetic polymer can be used alone or it can be blended with other materials, such as cotton or wool.

Organic disperse dyes are a well-known group of dyes having in common the property of being free of water-solubilizing ionic groups. Disperse dyes are derived from all of the major known chromophoric color systems. A majority of commercially available disperse dyestuffs are derived from azo, anthraquinone, quinophthalone, oxazine, diphenylamine, xanthene, methine, aminophthalimide or aminoketone systems, although other types are also well-known. Disperse dyes may also be metallized compounds. Any known disperse dye which can be used to dye the aforementioned synthetic polymers, especially in the form of films or fabrics, by aqueous dyeing procedures can be used in the process of this invention. Mixtures of dyes also are operable. Examples of useful dyes are included in Table 3.

TABLE 3

| | |
|---|---|
| Azo | |
| 3-[N-Methyl-p-(p-nitrophenylazo)-anilino] propionitrile | (orange) |
| 5'-[Bis(2-hydroxyethyl)amino]-2'-(2-chloro-4-nitrophenyl-azo)benzanilide, diacetate ester | (red) |
| p-[4-(o-Tolylazo)-o-tolylazo]phenol | (orange) |
| 3,3'-[p-(2-Chloro-4-nitrophenylazo)-phenylimino]-dipropionitrile | (orange) |
| 3-[4-(2,6-Dichloro-4-nitrophenylazo)-N-ethyl-m-toluidino]propionitrile | (brown) |
| Anthraquinone | |
| 1-Anilino-4,5-dihydroxy-8-nitroanthraquinone / 1,8-Dianilino-4,5-dihydroxyanthraquinone | (blue) |
| 1,4-Diamino-2,3-dichloroanthraquinone | (violet) |
| 1-Amino-4-hydroxy-2-(2-methoxyethoxy)-anthraquinone | (red) |
| 4'-(4-Hydroxy-1-anthraquinonylamino)-acetanilide | (blue) |
| Aminonaphthalimide | |
| 4-Amino-N-(2,4-xylyl)naphthalimide | (yellow) |
| 6-Methoxy-N-(p-methoxyphenyl)-1-nitrobenzo-[K1]thioxanthene-3,4-dicarboximide | (red) |
| Methine | |
| p-[Butyl(2-chloroethyl)amino]-α-cyanocinnamic acid, ethyl ester | (yellow) |
| α-Cyano-p-(N-methyl-p-phenetidino)-cinnamic acid, ethyl ester | (yellow) |
| 4-[Ethyl(2-hydroxy-3-phenoxypropyl)amino]-2-methyl-benzylidene malononitrile, carbanilate ester | (yellow) |
| Aminoketone | |
| N-[p-(Benzyloxy)phenyl]-2,5-cyclohexadiene-1,4-diimine | (green) |
| Diphenylamine | |

TABLE 3-continued

| | |
|---|---|
| N-(2,4-Dinitrophenyl)-p-phenylenediamine | (yellow) |
| 4-Chloro-4'-methoxy-2-nitrodiphenylamine | (orange) |
| 3-Nitro-N⁴-phenylsulfanilanilide | (yellow) |
| Quinophthalone | |
| 2-(3-Hydroxy-2-quinolyl)-1,3-indandione | (yellow) |
| 2-(4-Bromo-3-hydroxy-2-quinolyl)-1,3-indandione | (yellow) |

Textiles such as wool and cotton can also be dyed with appropriate dyes, that is, dyes other than disperse dyes, by the process of this invention. The band, padded with, for example, a direct, acid or fiber-reactive dye, can be subjected to the invention process.

Textile treating agents which are useful herein include conventional organic materials for improving the functional properties of synthetic organic polymers in the form of textiles. Examples of such materials include durable-press resins, oil and water repellent resins and chemicals, softeners, ultraviolet light screening agents, fire retardant chemicals, fluorescent brightening agents, bacteriostats, fungistats and antistatic agents. Examples of such materials are included in Table 4.

TABLE 4

| | | |
|---|---|---|
| 1. | 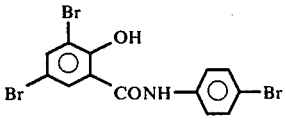 | Bacteriostat |
| 2. | 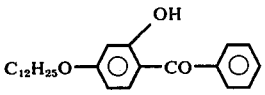 | Ultraviolet light screening agent |
| 3. | 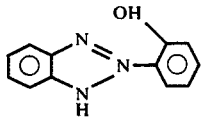 | Ultraviolet light screening agent |
| 4. | 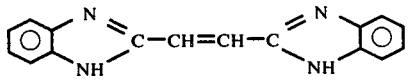 | Fluorescent brightening agent |
| 5. | 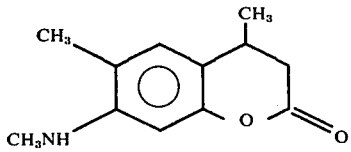 | Fluorescent brightening agent |
| 6. | 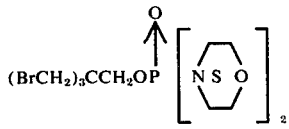 | Flameproofing agent |
| 7. | 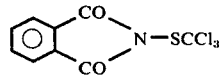 | Fungicide |
| 8 | 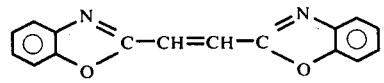 | Fluorescent brightening agent |

In the embodiment of the invention wherein dyes and/or textile agents are fixed, the dyes and/or agents are on the surface of the moving band and, in the course of the process, become fixed on the band and/or are cured. The application of dye and/or textile agent to the band material can be done by conventional means, for example, by spraying, padding or printing. The nature of the application is critical only to the extent that it must be suitable for the form and nature of the synthetic polymer being treated. For example, padding can be effected by application of a solvent-dye solution, a solubilized dye composition, a solvent-dye dispersion or a solvent-aqueous dye emulsion; aqueous printing or padding methods, employing a dispersion of the dye, can also be used. The use of a solvent system is preferred. Printing may also be carried out, for example, electrostatically, by procedures well known in the art.

In that embodiment of the invention wherein disperse dyes and/or textile agents are fixed in disperse dyeable polymers by dissolution in the polymer, it is important, to ensure rapid fixation, that the temperature of the polymer be brought at least to its glass transition temperature. The glass transition temperature of a synthetic polymer varies not only with the chemical nature of the polymer but also with its past history. For example, polyethylene terephthalate has a glass transition temperature of 67° C. in the amorphous condition, 81° C. in the crystalline condition and 125° C. when crystalline and oriented. Polyamides and other polymers behave similarly.

The curing rate of curable textile agents, such as the methylolamines, varies with temperature. As throughput rate is economically important and is an important characteristic of the instant process, it is preferred to operate at the highest temperature that does not degrade the band, dye or agent. The fluorocarbons which are used herein are particularly suitable in that they are highly stable; they do not themselves degrade under process conditions and they tend to protect other materials by excluding atmospheric oxygen from the process. Although the optimum temperature will vary with the nature of the band, dye or agent, a band temperature of about 150–200° C. is generally preferred. The vapors in the heat transfer region generally will be somewhat hotter, for example, as high as 220° C., to ensure efficient heat transfer to the band.

In the embodiment of the invention wherein the band of material is discontinuous, for example, a powder, the material, borne on a support with which it may or may not interact, may be heated to effect a heat-activated reaction. Examples of such heat-activated reactions include crosslinking, sintering, a sintercoating and drying.

From the heat transfer region the moving band passes immediately and directly into the purging region wherein residual vapor values from the fluorocarbon are recovered by displacement from the band with dry steam at a temperature sufficient to prevent condensation on the solid material. If, as is preferable, the temperature of the solid material is above the boiling point of water at the prevailing pressure, the steam need be only free of liquid water, in which event the sensible heat of the solid material will prevent condensaton as the steam displaces the vapor values. If the temperature of the solid material is below the boiling point of water at the prevailing pressure, sufficient heat must be supplied by the superheat of the steam to exceed that temperature. Dry superheated steam at a temperature above about 100° C. at atmospheric pressure is preferred with the steam flow contacting the band in a manner countercurrent to the band direction and, if the band is porous, the steam should flow through the band. The pressure within the purging region is preferably slightly greater than that within the heat transfer region to minimize loss of fluorocarbon vapor from the latter region. The steam carries the fluorocarbon vapor values to a condenser wherein fluorocarbon liquid and water condense. The fluorocarbon liquid can be separated from the water and returned to the heat transfer region.

Figure 3:
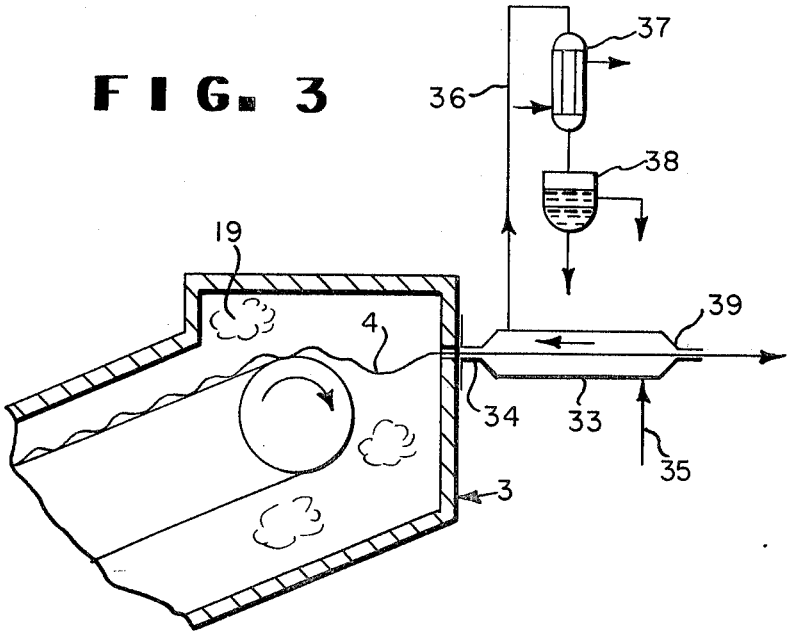
FIG. 3 is an elevation view showing a purging chamber at the band outlet end of a heat-transfer chamber.
Figure 2:
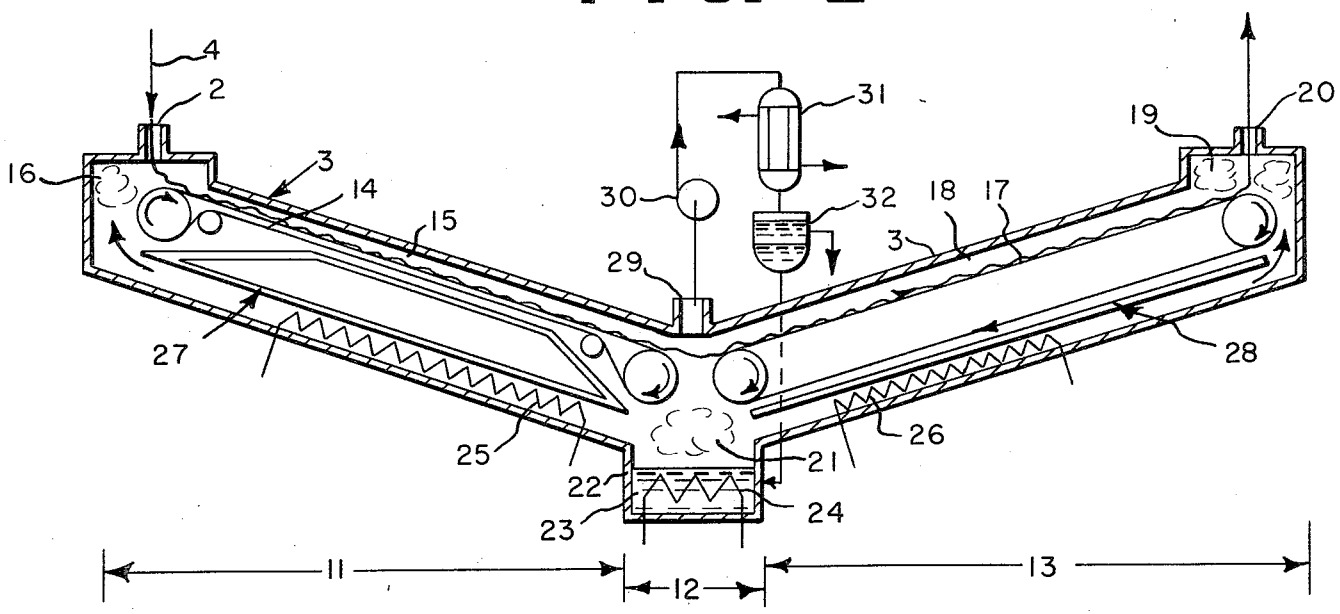
FIG. 2 is an elevation view showing a heat-transfer chamber.

FIGS. 1, 2 and 3 include various portions of one particular type of device which may be used to carry out the process of this invention. It is to be understood that the description of the device is not intended to be limiting on the process itself. The device represented by FIGS. 1, 2 and 3 comprises:

a. a substantially enclosed purging-drying chamber having a band inlet and a band outlet and having connected thereto means for generating and circulating the superheated condensable vapor of a liquid having an atmospheric pressure boiling point of less than about 120° C;

b. a substantially enclosed heat transfer chamber having a band inlet and a band outlet and means for conveying the band through the chamber, said band inlet being integrally connected to the band outlet of the purging-drying chamber, said band inlet and band outlet being at about the same height levels and above any other openings in the chamber, said chamber being adapted to operate at a pressure no greater than that in the purging-drying chamber and to contain liquid, vapor and superheated vapor of a fluorocarbon having a fluorine to carbon atom ratio of at least 1.5, a solubility parameter of not more than 6.5 and a molecular weight of at least 300, said chamber comprising three zones as follows:

1. a first zone sloping downward from said band inlet to the second zone and including means for superheating vapors of the fluorocarbon and baffle means for placing the superheated vapors in circulation within the zone;
2. a secondd zone having means to contain and convert the fluorocarbon to vapor and means for withdrawing vapor from the zone, condensing the withdrawn vapor and returning to the zone any liquid fluorocarbon which may be separated from the condensed vapor; and
3. a third zone sloping upward from the second zone to the band outlet and including means for superheating vapors of the fluorocarbon and baffle means for placing the superheated vapors in circulation within the zone; and c. a substantially enclosed purging chamber having a band inlet and a band outlet, having connected thereto means for generating and circulating dry superheated steam and means for recovering fluorocarbon entering the chamber from the heat transfer chamber and being adapted to operate at a pressure no less than in the heat transfer chamber, said band inlet being integrally connected to the band outlet of the heat transfer chamber.

FIG. 1 illustrates the purging-drying chamber 1 attached to the band inlet 2 of a heat transfer chamber housing 3. Chamber 1 prevents loss of fluorocarbon from housing 3 through inlet 2 and serves to dry band 4, if wet from a previous process step. Whereas it is preferred to employ the invention process for heat fixing dyes and textile agents, it is most preferred to employ the process for drying and fixing polyester fabric which has been padded (in a previous process step) with a disperse dye in 1,1,2-trichloro-1,2,2-trifluroethane. In this preferred embodiment, disperse dye padded band 4, wet with 1,1,2-trichloro-1,2,2-trifluoroethane, enters band inlet 5 of FIG. 1, passes through purging-drying chamber 1 and band outlet 6 and thence through inlet 2. During passage through chamber 1, band 4 is contacted with superheated vapor of 1,1,2-trichloro-1,2,2-trifluoroethane, preferably in countercurrent flow as shown. The contact is carried out at a temperature and for a time such that essentially all liquid 1,1,2-trichloro-1,2,2-trifluoroethane is evaporated from band 4. The vapors are carried out of chamber 1 through line 7. An amount of vapor corresponding approximately to the amount removed from band 4 is diverted to condenser 8 where it is condensed and recovered for reuse. The remainder of the stream passes into blower 9 which forces the vapor through superheater 10 restoring to the vapor essentially the amount of supherheat given up by the vapor in evaporating the 1,1,2-trichloro-1,2,2-trifluoroethane originally wetting the band.

Alternatively, dry steam may be employed in the device shown in FIG. 1. If band 4 is wet with water-immiscible liquid, then a phase separator downstream from the condenser is employed for the recovery of the liquid. If the band is not wet, dry steam is passed slowly through the device in order to ensure that air, which is noncondensable, does not enter the second region. Although chamber 1 is employed preferably in the vertical mode as shown in FIG. 1, this mode is not critical and other modes, such as horizontal, can be employed.

FIG. 2 shows the heat transfer chamber 3 comprising zone 11, zone 12 and zone 13. A moving band 4 enters zone 11 through inlet 2 which is situated at least as high as all other openings (in housing 3) which are in direct vapor communication with the atmosphere so that vapor losses by flow out of housing 3 are minimized. Band 4 is carried by transport belt 14 through cocurrent contact zone 15 wherein band 4 is contacted with superheated vapors 16 of one or more fluorocarbons as defined. Thereafter, band 4 spans zone 12 and is carried by transport belt 17 through countercurrent contact zone 18 wherein band 4 is contacted with superheated vapors 19. Band 4 is thereafter withdrawn from the device through band outlet 20 which is situated at least as high as all other openings (in housing 3) which are in direct vapor communication with the atmosphere. Saturated vapors 21 of the fluorocarbon are produced by boiler 22 which heats liquid fluorocarbon 23 by means of heater 24. The saturated vapors pass upwardly over heaters 25 and 26 where they are heated to produce superheated vapors 16 and 19. Thereafter, the superheated vapors return to zone 12 via cocurrent contact zone 15 and countercurrent contact zone 18. Baffle 27 in zone 11 separates fluorocarbon vapor contacting superheater 25 from the fluorocarbon vapor contacting the band of material in contact zone 15. Likewise, baffle 28 in zone 13 separates fluorocarbon vapor being superheated by superheater 26 from vapor in contact zone 18. Opening 29 connects with a recovery loop whose purpose is to free the fluorocarbon of water which may enter the device or, with modifications not shown, to recover other condensable liquids which may enter the device on the band, for example, traces of liquid from a pad liquor. Blower 30 removes vapor according to need from zone 12 and passes it through condenser 31 wherein the vapors condense. The upper phase (water) is separated in separator 32 and discarded. The lower phase in this embodiment, principally fluorocarbon, is returned to boiler 22. Alternatively, the phase may be continuously fractionally distilled and the fractions returned to the process for reuse as appropriate.

FIG. 3 shows the purging chamber 33 attached at the band outlet of a heat transfer chamber housing. It may be noted that the position of the band outlet has been changed from the horizontal wall to the vertical wall of the chamber housing (as shown in FIG. 2). Band 4 containing small amounts of fluorocarbon vapor, for example, in interstices, passes through band inlet 34 into chamber 33. Superheated steam enters chamber 33 through steam connection 35, contacts band 4, preferably countercurrently as shown, and fluorocarbon vapors are swept from the band and carried out of the chamber for the most part through line 36 into condenser 37. Condensed steam and fluorocarbon are separated in separator 38, the fluorocarbon being recovered for reuse. Band 4 exits through band outlet 39. The chamber 33 is shown in the usually preferred horizontal mode. Other modes are operable and under some circumstances may be preferred.

The pressures within the three chambers represented by FIGS. 1, 2 and 3 are so regulated that the heat transfer chamber is operated at a pressure which is no greater than the pressures in the other two chambers so as to ensure that fluorocarbon, which may be expensive, is not lost to the atmosphere. In a most preferred embodiment of this invention, fabric is padded with 1,1,2-trichloro-1,2,2-trifluoroethane pad liquor, the padder being at approximately ambient temperature within an enclosure connected to band inlet 5 (FIG. 1). The padded band is dried in the manner already described. The relatively small amounts of air, some of which may accompany the band and some of which may be drawn into purging-drying chamber 1 to replace vapor passing into the heat exchange chamber through band inlet 2, pass out of the system through condenser 8.

We claim:

1. Process for rapidly and efficiently transferring heat to a moving band of solid material with minimum energy expenditure and freedom from environmental pollution, which process comprises:

a. passing the band through a substantially enclosed purging-drying region through which the superheated condensable vapor of a water-immiscible liquid having an atmospheric pressure boiling point of greater than 20° C. but less than about 120° C. is substantially concurrently passed to dry the band and/or purge noncondensable gas from the band;

b. immediately passing the band from (a) through a substantially enclosed heat transfer region containing circulating superheated condensable vapor of a fluorocarbon having a fluorine to carbon atom ratio of at least 1.5, a solubility parameter of not more than 6.5, a molecular weight of at least 300 and a circulation driving force of greater than 5.1 cm. of water, to effect the desired heat transfer, the heat transfer region being substantially free of noncondensable gas and at a pressure no greater than that in the purging-drying region;

c. immediately passing the band from (b) through a substantially enclosed purging region through which dry steam is substantially concurrently passed to purge fluorocarbon vapor from the band, the purging region being substantially free of noncondensable gas and at a pressure which is no less than that in the heat transfer region;

d. passing the band, substantially free of fluorocarbon, out of the purging region and recovering the band; and e. recovering and recycling fluorocarbon from the heat transfer and purging regions.

2. Process of claim 1 wherein the moving band is a textile fabric.

3. Process of claim 2 wherein the textile fabric contains a dye which requires fixing on the fabric.

4. Process of claim 3 wherein the dye is a disperse dye.

5. Process of claim 2 wherein the textile fabric contains a textile agent which requires fixing and/or curing on the fabric.

6. Process of claim 1 wherein the liquid from which the superheated condensable vapor of (a) is derived is 1,1,2-trichloro-1,2,2-trifluoroethane.

7. Process of claim 1 wherein the fluorocarbon in (b) is a fluorinated alkane, fluorinated cycloalkane, fluorinated alkyl ether, fluorinated cycloalkyl ether, fluorinated tertiary alkyl amine, fluorinated tertiary cycloalkyl amine or a perfluoropropylene oxide of the formula $F(CF(CF_3)CF_2O)_nCHFCF_3$ wherein $n$ is 2–9.

8. Process of claim 7 wherein the fluorocarbon is of said formula wherein $n$ is 3–5.

9. Process of claim 1 wherein the liquid from which the superheated condensable vapor of (a) is derived is 1,1,2-trichloro-1,2,2-trifluoroethane and the fluorocarbon in (b) is of the formula $F(CF(CF_3)CF_2O)_4CHFCF_3$.

10. Process of claim 2 wherein the textile fabric is a polyester.

11. Process of claim 1 wherein the superheated condensable vapor in (a) is dry steam.

12. Process of claim 1 wherein the liquid from which the superheated condensable vapor of (a) is derived is a fluorine-containing compound of specific heat less than about 0.3 calorie/gram/° C. at about 25° C. and of latent heat of vaporization less than about 50 calories/gram.

13. Process of claim 12 wherein the fluorine-containing compound is a fluoro or chlorofluoro substituted aliphatic or cycloaliphatic hydrocarbon.

* * * * *